US009164472B2

(12) United States Patent
Sekido et al.

(10) Patent No.: US 9,164,472 B2
(45) Date of Patent: Oct. 20, 2015

(54) IMAGE FORMING APPARATUS

(75) Inventors: Kota Sekido, Numazu (JP); Hiromi Sakurai, Suntou-gun (JP); Tomoya Tateishi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 330 days.

(21) Appl. No.: 13/209,040

(22) Filed: Aug. 12, 2011

(65) Prior Publication Data

US 2012/0039625 A1 Feb. 16, 2012

(30) Foreign Application Priority Data

Aug. 16, 2010 (JP) ..... 2010-181891
Jul. 29, 2011 (JP) ..... 2011-166757

(51) Int. Cl.
*G03G 15/00* (2006.01)
*G03G 21/16* (2006.01)

(52) U.S. Cl.
CPC .... *G03G 21/1633* (2013.01); *G03G 2215/0875* (2013.01)

(58) Field of Classification Search
CPC ..... G03G 21/1633; G03G 2215/0875
USPC ..... 399/110, 119, 125
See application file for complete search history.

(56) References Cited

U.S. PATENT DOCUMENTS

2010/0054797 A1* 3/2010 Takeyama et al. ..... 399/111

FOREIGN PATENT DOCUMENTS

| | | | |
|---|---|---|---|
| JP | 11-130146 | A | 5/1999 |
| JP | 11-218983 | A | 8/1999 |
| JP | 2006-154614 | A | 6/2006 |
| JP | 2006-171407 | A | 6/2006 |
| JP | 2007-298857 | A | 11/2007 |
| JP | 2010-060613 | A | 3/2010 |

* cited by examiner

*Primary Examiner* — David Gray
*Assistant Examiner* — Thomas Giampaolo, II
(74) *Attorney, Agent, or Firm* — Canon USA, Inc., IP Division

(57) ABSTRACT

In an image forming apparatus, when the openable and closable member is closed, the regulating member is mounted to the main body of the apparatus in a second state that is elastically changed from a first state; when the openable and closable member is opened, the regulating member is elastically returned to the first state; in this state, when the openable and closable member is closed, an abutting portion of the openable and closable member abuts on an abutting portion of the regulating member to regulate the openable and closable member from closing. A direction of pressing caused when the abutting portion of the openable and closable member abuts on the abutting portion of the regulating member is different from a direction in which the abutting portion of the regulating member moves when the regulating member changes from the first state to the second state.

17 Claims, 10 Drawing Sheets

IMAGE FORMING APPARATUS

BACKGROUND OF THE INVENTION

1. Field of the Invention

The present invention relates to an image forming apparatus such as a printer, a copy machine, and a facsimile that forms an image on a sheet, and more particularly, to an image forming apparatus to which a removable member is mounted when it is shipped and from which the removable member is removed before it is used.

2. Description of the Related Art

Due to vibration or shock that an image forming apparatus incurs while it is being transported, a movable unit set in a movable state is moved and damages itself or a body of the apparatus, thereby causing filler contained in the apparatus to leak. Thus, the apparatus is often shipped with following removable members mounted therein. The removable members include a member that fixes the movable unit to prevent it from moving relative to the body of the apparatus due to vibration or shock, a member that covers specific parts for protection, and a member that prevents the filler from leaking.

To use the apparatus, a user needs to remove the removable members. If the user forgets to remove it, the image forming apparatus may not operate correctly or generate troubles. Japanese Patent Application Laid Open No. 2007-298857 discusses a configuration in which, when using the apparatus, if the user opens an apparatus door, mounts a cartridge, and then tries to close the door without removing the removable member, the cartridge and the removable member interferes with each other, which prevents closing of the door. With such a configuration, the user can easily recognize that he has forgotten to remove the removable member and can remember removing the removable member.

As described above, Japanese Patent Application Laid Open No. 2007-298857 discusses a method that causes the user who mounts the cartridge into the apparatus before using the apparatus, to recognize the removable member and remember removing it.

However, in recent years, for a purpose of reducing a volume of a packing member, an image forming apparatus has been transported with the cartridge mounted therein. Accordingly, since a user does not mount the cartridge before using the apparatus, the configuration discussed in Japanese Patent Application Laid Open No. 2007-298857 cannot be adopted.

SUMMARY

The present disclosure is directed to provide an image forming apparatus that can make the user easily recognize that he has forgotten to remove a removable member regardless of other members, before using the apparatus.

According to an aspect of the present invention, an image forming apparatus including: an openable and closable member capable of opening and/or closing relative to the image forming apparatus; and a regulating member configured to restrict a movement of a member for forming an image, the regulating member being removable from a main body of the apparatus in which an openable and closable member is opened, wherein, when the openable and closable member is closed, the regulating member is mounted to the main body of the apparatus in a second state that is elastically changed from a first state; when the openable and closable member is opened, the regulating member is elastically returned to the first state: in the second state state, when the openable and closable member is closed, an abutting portion of the openable and closable member abuts on an abutting portion of the regulating member to regulate the openable and closable member from closing; and a direction of pressing caused when the abutting portion of the openable and closable member abuts on the abutting portion of the regulating member is different from a direction in which the abutting portion of the regulating member moves when the regulating member changes from the first state to the second state.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Dimensions, materials, and shapes of basic components described in an exemplary embodiment, and relative positions thereof are appropriately changed depending on a configuration and various conditions of an apparatus to which the present invention is applied.

Figure 1:
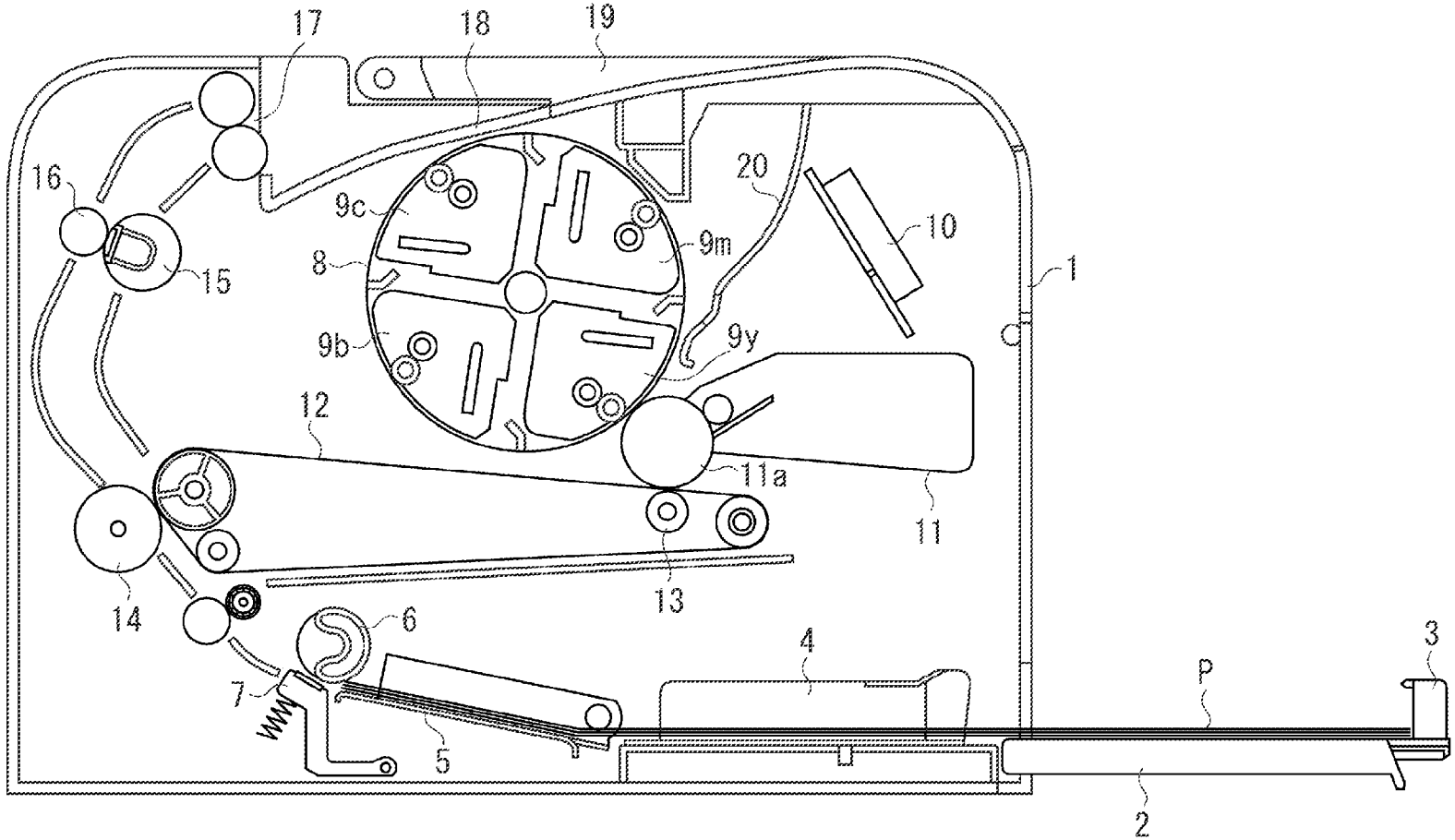
FIG. 1 is a vertical cross sectional view of an image forming apparatus.

Firstly, an image forming apparatus of a first exemplary embodiment will be briefly described. FIG. 1 is a schematic configuration diagram illustrating the image forming apparatus of the present exemplary embodiment. An image forming apparatus 1 is provided with a paper feed tray 2 for supplying sheets, which protrudes forward and outside a casing of the image forming apparatus 1. The paper feed tray 2 stacks and stores a bundle of sheets "P" to be forwarded into the image forming apparatus 1. The sheet "P" on the paper feed tray 2 is conveyed into the image forming apparatus 1 by a paper feed roller 6 and a separation pad 7.

The image forming apparatus 1 is provided with a rotary developing device 8, to which four developing cartridges 9 (9*y*, 9*m*, 9*c*, and 9*b*) are removably mounted. Each developing cartridge 9 includes each development roller 91 (91*y*, 91*m*, 91*c*, and 91*b*) that stores a toner of a different color (yellow, magenta, cyan, and black). Further, a cartridge 11 including a photosensitive drum 11*a* is removably mounted in the image forming apparatus 1.

Next, an image forming process for forming a color image will be described. First, on the rotating photosensitive drum 11*a*, the image forming processing of charge, exposure, development and primary transfer is performed. The charge is uniformly performed on a surface of the photosensitive drum 11*a* by a charge unit (not illustrated). The exposure is performed by irradiating the surface of the charged photosensitive drum 11*a* with a laser from a laser exposure unit 10 to form a latent image (electrostatic latent image) on the surface. While the latent image is being formed, the rotary developing device 8 is rotated to place the developing cartridge 9*y* at a development position (position illustrated in FIG. 1) to perform the development with the yellow toner.

The development is performed by applying a voltage (development bias) having the same polarity and almost same potential as that of a charge polarity on the photosensitive drum 11*a*. By applying the development bias, the yellow toner is caused to adhere to the latent image on the photosensitive drum 11*a* from developing roller 91*y*, and then the latent image is visualized as an yellow toner image (developed by the toner). After the development, the primary transfer is performed by applying the voltage (primary transfer bias) having an opposite polarity to the yellow toner, to a primary transfer roller 13 provided inside an intermediate transfer belt 12. By applying the primary transfer bias, the yellow toner image on the photosensitive drum 11*a* is transferred onto the intermediate transfer belt 12.

After the primary transfer, the toner remaining on the photosensitive drum 11*a* is cleaned by a cleaning unit 11*b* included in the cartridge 11. When the development with the yellow toner is completed, the rotary developing device 8 is rotated and the developing cartridge 9*m* moves to the development position to perform the development with a next magenta toner.

Similar to the yellow toner, after the charge and the exposure are performed on the photosensitive drum 11*a*, the development is performed with the magenta toner, and then the primary transfer is performed with the magenta toner image superimposed onto the yellow toner image onto the intermediate transfer belt 12. In the following processing for cyan and black, the charge, the exposure, the development, and the primary transfer are sequentially performed in a similar manner, and then four color toner images are superimposed on an intermediate transfer belt 12.

Next, second transfer is performed. While the primary transfer is being performed, the intermediate transfer roller 14 is not in contact with the intermediate transfer belt 12. When the primary transfer on the four toner images are completed, the intermediate transfer roller 14 abuts on the intermediate transfer belt 12 to forma nip portion. The sheet "P" is conveyed to a nip portion so that a position of the sheet "P" and positions of the four toner images on the intermediate transfer belt 12 correspond to one another.

The second transfer is performed by applying to the intermediate transfer roller 14 the voltage having the opposite polarity (second transfer bias) to the toner. By applying the second transfer bias, the four toner images on the intermediate transfer belt 12 are collectively second transferred onto the sheet "P".

Next, the toner images on the sheet "P" is fixed on the sheet "P". The sheet "P" onto which the toner images are transferred is heated and pressed by a fixation unit including a heating device 15 and a pressing roller 16 to fix the toner images on the sheet "P". Subsequently, the sheet "P" is discharged through a sheet discharge opening 17 and fed to a discharge unit 18.

When exchanging the developing cartridge 9, the user opens a door 19, which serves as an openable and closable member that can be opened/closed (i.e., opened and/or closed) in the image forming apparatus 1, upward to expose an inside of the apparatus, thereby enabling to access the developing cartridge 9 mounted in the rotary developing device 8. When the developing cartridge 9 is mounted/removed, the developing cartridge 9 is guided by a cartridge guide 20 so that the user can mount/remove the developing cartridge 9 smoothly.

The rotary developing device 8 is rotated and driven to form the image as described above, and then sequentially moves the developing cartridge 9 of each color to the development position. At this point, since the developing roller 91 and the photosensitive drum 11*a* have a positional relationship in which, if the rotary developing device 8 is simply rotated, the developing roller 91 and the photosensitive drum 11*a* scrub each other, the surface of the image forming apparatus 11*a* can be damaged. Thus, when the rotary developing device 8 is rotated, a rotation axis of the rotary developing device 8 is moved in a direction of an arrow illustrated in FIG. 2 to retract the rotary developing device 8, and the developing roller 91 and the photosensitive drum 11*a* are set apart not to scrub each other.

Since this retracting mechanism is provided, the rotary developing device 8 is retained in the image forming apparatus 1 in a state where the rotary developing device 8 has a clearance of a movement amount for retracting relative to the main body of the image forming apparatus 1. Therefore, due to vibration or shock that the image forming apparatus 1 incurs while it is being transported, the rotary developing device 8 swings or moves relative to the image forming apparatus 1, and thus may hit or contact other surrounding members within the apparatus and damage each other.

Particularly, when the apparatus is shipped with the developing cartridge 9 mounted on the rotary developing device 8, since the rotary developing device 8 becomes heavy, the apparatus is highly likely to be damaged. Thus, the image forming apparatus 1 of the present invention is shipped in a state where the image forming apparatus 1 is provided with a fixation member (removable member), which is referred to as a ship lock 21, and the rotary developing device 8 is fixed to the main body of the image forming apparatus 1 with the fixation member not to be permitted to move. The ship lock 21 refers to a member for fixing or regulating rotation or movement of the movable unit, which is held rotatable and movable within the apparatus.

Figure 2:
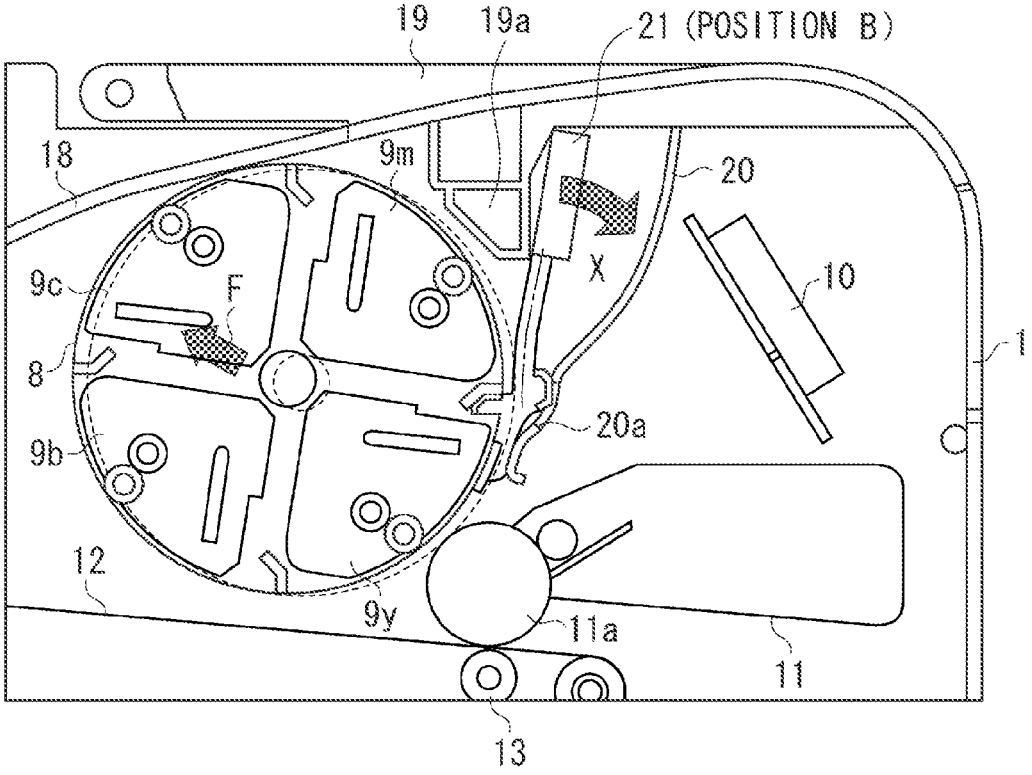
FIG. 2 is an image forming apparatus with a ship lock mounted.
Figure 3:
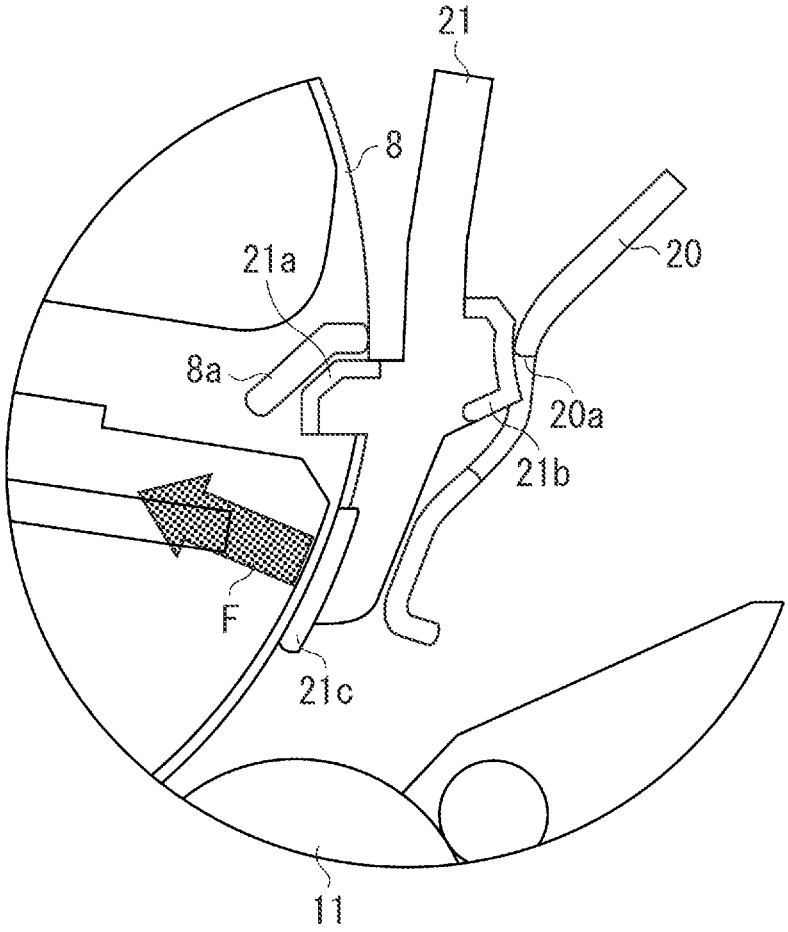
FIG. 3 is an enlarged view of a ship lock mounted portion of an image forming apparatus with a ship lock mounted.

Next, the ship lock 21 functioning as the fixation member will be described. First, fixation of the rotary developing device 8 using the ship lock 21 mounted on the image forming apparatus 1 will be described. FIG. 2 illustrates the image forming apparatus 1 with the ship lock 21 mounted. FIG. 3 is an enlarged view of a ship lock mounted portion of an image forming apparatus 1. The ship lock 21 is mounted between the rotary developing device 8 and the cartridge guide 20. With the ship lock 21 mounted, a protrusion 21*a* of the ship lock 21 engages with a stopper 8*a* provided for the rotary developing device 8 and, a protrusion 21*b* engages with a stopper 20*a* provided for the cartridge guide 20.

In a state where the door 19 is closed relative to the image forming apparatus 1, as illustrated in FIG. 2, the ship lock 21 abuts on a protruding portion 19*a* provided in the door 19 and is held elastically deformed in an arrow X direction. As described above, the ship lock 21 can be elastically deformed. A position of a portion of the ship lock 21 that is elastically deformed in this state is defined as a position "B", and a shape of the ship lock 21 in this state is defined as a second shape.

In a state where the ship lock 21 is elastically deformed as described above, using a stopper 21*a* as a supporting point, a rotary developing unit pressing unit 21*c* applies a force "F" to the rotary developing device 8. Therefore, the rotary developing device 8 is urged in an arrow direction of the force "F" illustrated in FIG. 3 and thrust toward the image forming apparatus 1, so that the rotary developing device 8 is fixed and does not move relative to the image forming apparatus 1. Further, the ship lock 21 itself is fixed within the image forming apparatus 1 at a time.

As described herein, the ship lock 21 is fixed within the image forming apparatus 1 and the clearance of the rotary developing device 8 is clogged, or occupied with the ship lock 21. Thus, the rotary developing device 8 is fixed and does not move relative to the image forming apparatus 1. The ship lock 21 is formed of a material that can be easily and elastically deformed by a large amount, for example, polypropylene (PP).

Next, removable of the ship lock 21 from the image forming apparatus 1 will be described. The user opens the door 19, holds an upper portion of the ship lock 21, pulls the ship lock 21 upward with more than a certain force, and then the engagement of the protrusion 21*a* and the protrusion 21*b* are released to remove the ship lock 21. When the ship lock 21 is removed, the rotary developing device 8 moves in a direction opposite to the arrow "F" illustrated in FIG. 3 and the image forming apparatus 1 is normally operated to perform a print operation.

Figure 4:
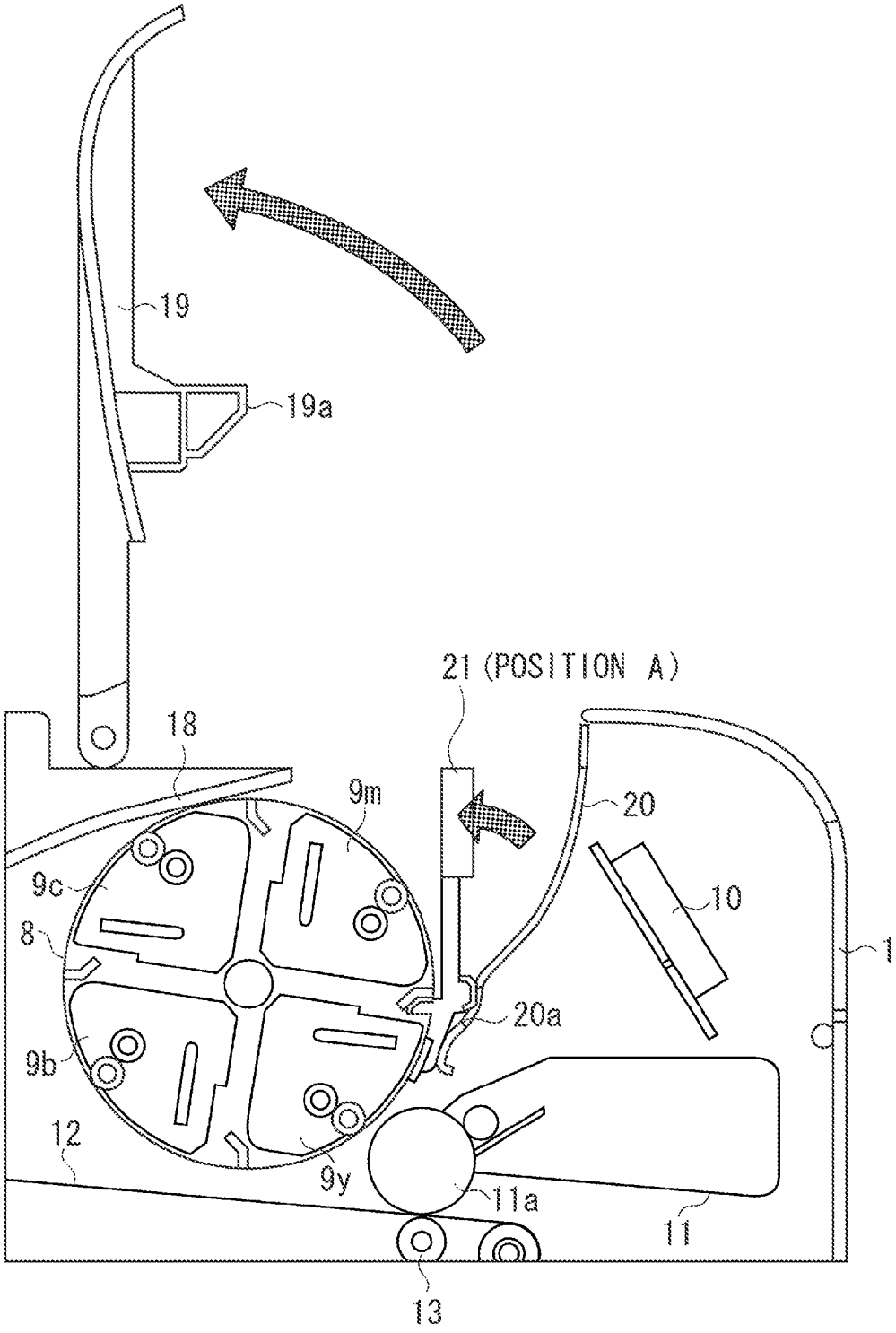
FIG. 4 is a vertical cross sectional view of an image forming apparatus with a ship lock mounted and with a door opened.
Figure 5:
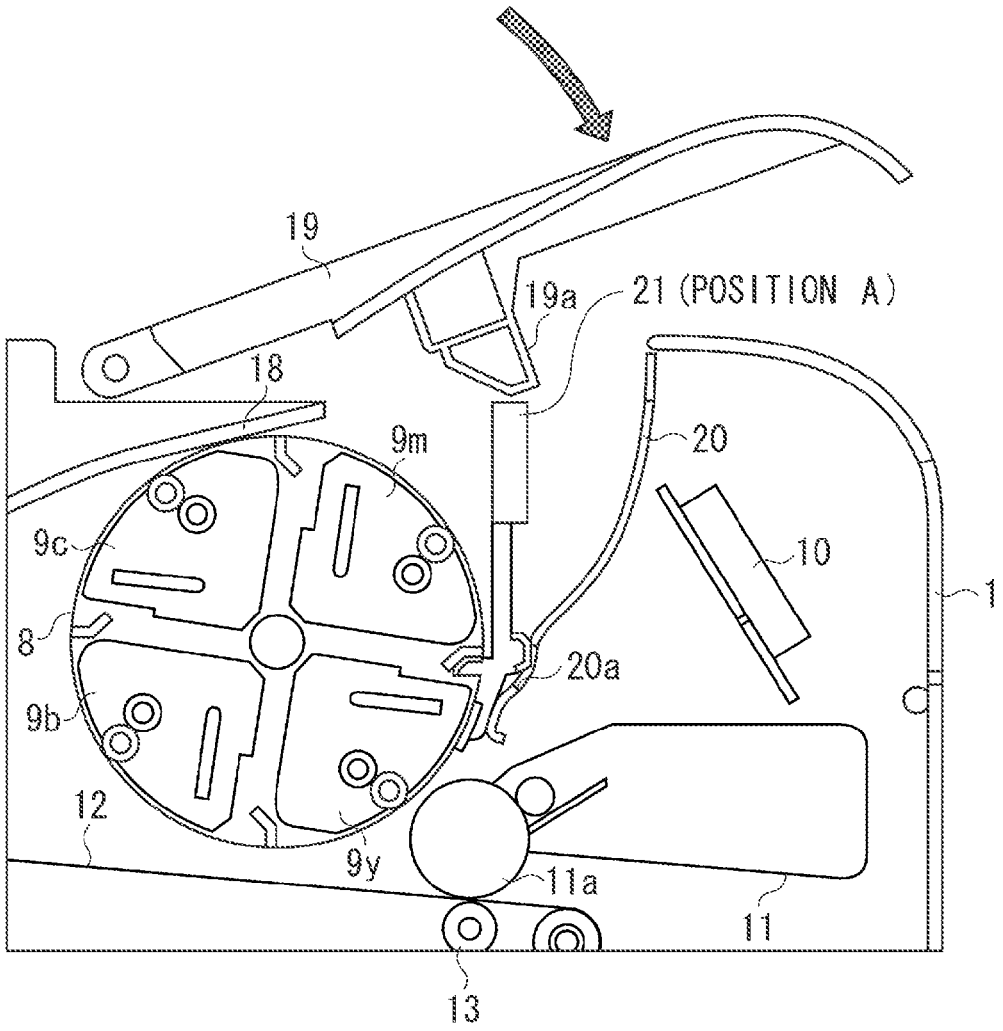
FIG. 5 is a vertical cross sectional view of an image forming apparatus with a ship lock mounted when a door is going to be closed.

Next, a mechanism for making the user recognize that the user has forgotten to remove the ship lock 21 will be described. FIG. 4 illustrates a state where the door 19 of the image forming apparatus 1 with the ship lock 21 mounted is opened. FIG. 5 illustrates a state of the image forming apparatus 1 with the ship lock 21 mounted when the door 19 is going to be closed. In a state where the image forming apparatus 1 is mounted with the ship lock 21 when the door 19 is closed as illustrated in FIG. 2, if the door 19 is opened, the protruding portion 19*a* of the door 19 is moved to be set apart from the ship lock 21.

More specifically, a member (protruding portion 19*a*) which presses an elastically deformed portion of the ship lock 21 to retain the deformation, is retracted. Therefore, a position of the elastically deformed portion returns from the position "B" to a position "A". A shape of the ship lock 21, when the elastically deformed portion returns to the position "A" is defined as a first shape. By opening the door 19, the ship lock 21 is automatically restored (changed) from an elastically deformed second shape (second state) to the first shape (first state).

In a state where the image forming apparatus 1 is mounted with the ship lock 21 in the first shape, if the door 19 is going to be closed, as illustrated in FIG. 5, since the ship lock 21 abuts on the protruding portion 19*a* of the door 19, the door 19 cannot be closed. This is because, when the ship lock 21 is restored from the second shape to the first shape, the elastically deformed portion of the ship lock 21 moves into a locus where the protruding portion 19*a* moves when the door 19 is being closed.

Normally, the user pulls and removes the ship lock 21. However, if the user is going to close the door 19 again without removing the ship lock 21, the ship lock 21 interferes with the protruding portion 19*a*, and thus the door 19 cannot be closed. Since the door 19 is not closed but half opened, the user can easily detect a problem visually and recognize that the user has forgotten to remove the ship lock 21.

Further, the image forming apparatus 1 is provided with a detection unit (not illustrated) that detects an opening/closing state of the door 19. It is configured such that so long as the door 19 is not closed, the image forming apparatus 1 cannot be activated. Thus, the image forming apparatus 1 can be prevented from starting and providing a driving force in a state where the position of the rotary developing device 8 is incorrect, so that each component of the image forming apparatus 1 incurs stress.

Further, a state as illustrated in FIG. 5 will be described, where the door 19 is being closed again without removing the ship lock 21, namely a state where the ship lock 21 is mounted to the image forming apparatus 1 in the first shape (first state). If the user is going to close the door 19, the protruding portion 19*a* of the door 19 abuts on the ship lock 19. Thus, the ship lock 21 is pressed downward by the protruding portion 19*a* in FIG. 5 when the ship lock 21 interferes with the protruding portion 19*a*. On the other hand, when a state of the ship lock 21 changes from the first state to the second state, the elastically deformed portion of the ship lock 19 moves in a right direction in FIG. 5, accordingly the above two directions are different from each other. Therefore, if a user tries to close the door 19 without removing the ship lock 29, closing of the door 19 is more certainly hindered in comparison with a case in which the two directions (i.e., the pressing direction of the protruding portion 19*a* and the elastically deforming direction) are the same.

Next, mounting the ship lock 21 on the image forming apparatus 1 before shipping will be described. First, with the door 19 opened, the ship lock 21 is inserted and mounted from above between the rotary developing device 8 and the cartridge guide 20. In this state, the protrusion 21*a* engages with the stopper 8*a* of the rotary developing device 8, and the protrusion 21*b* engages with the stopper 20*a* of the cartridge guide 20. The ship lock 21 has the first shape, and the portion thereof to be elastically deformed is positioned at the position "A".

Next, using a special tool (not illustrated), the portion of the ship lock 21 to be elastically deformed is urged in an arrow "X" direction illustrated in FIG. 2 to move to the position "B", and then is elastically deformed into the second shape. When urged by the tool, since the portion of the ship lock 21 to be elastically deformed is retracted from the locus where the protruding portion 19*a* moves when the door 19 is closed. Thus, the door 19 is not prevented from closing and the door 19 can be closed. When the urging of the ship lock 21 by the tool is released after the door 19 is closed, the ship lock 21 abuts on the protruding portion 19*a* and is regulated from returning from the second shape to the first shape, and thus the second shape is maintained.

According to the present exemplary embodiment, a film (not illustrated) whose one end adheres to the elastically deformed portion of the ship lock 21 is used as the tool. With the ship lock 21 mounted, another end of the film is pulled to elastically deform the ship lock 21. In this state, the door 19 is closed. The film is nipped by the door 19. When the user removes the ship lock 21 from the image forming apparatus 1, the film can be also removed. The image forming apparatus 1 is shipped with the ship lock 21 mounted as described above, and after shipment, the ship lock 21 is maintained elastically deformed and mounted on the image forming apparatus 1 until the user opens the door 19.

Figure 6A:
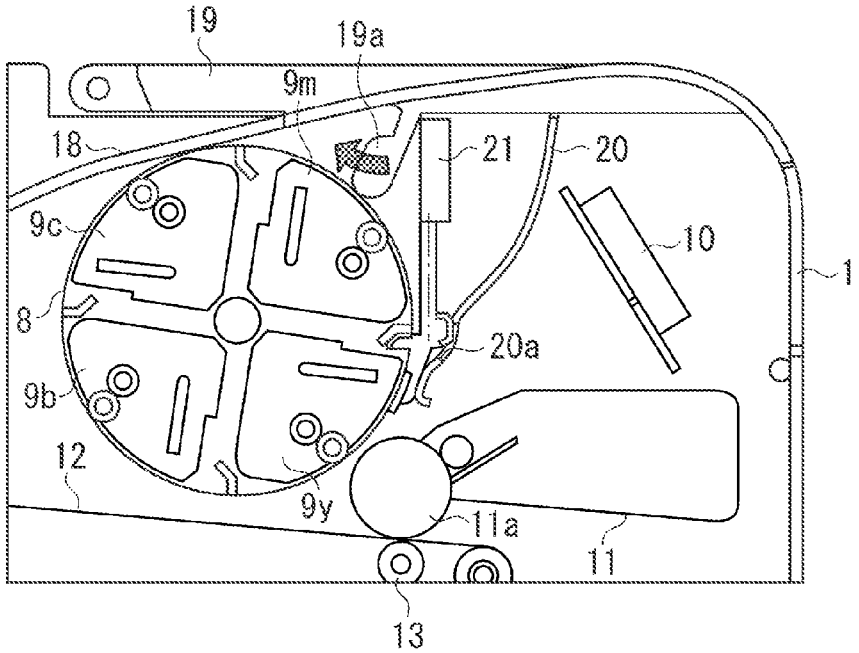
FIG. 6A is a vertical cross sectional view of an image forming apparatus with a ship lock mounted and with a door closed.
Figure 6B:
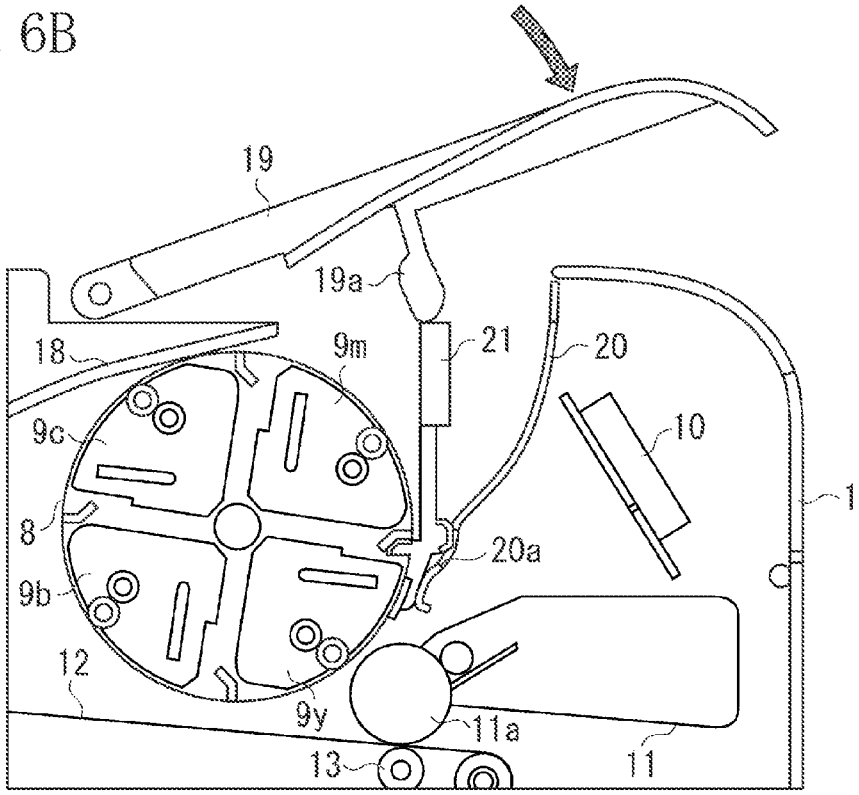
FIG. 6B is a vertical cross sectional view of an image forming apparatus with a ship lock mounted and with a door opened.

Further, according to the present exemplary embodiment, the ship lock 21 is elastically deformed. However, as illustrated in FIG. 6A, the protruding portion 19*a* of the door 19 may be elastically deformed. FIG. 6A illustrates a state in which the door 19 is closed, and FIG. 6B illustrates a state in which the door 19 is opened. In the state where the door 19 is closed as illustrated in FIG. 6A, the protruding portion 19*a* is elastically deformed to abut on the ship lock 21, and thus the deformed state is maintained. At this point, the door 19 has the second shape.

In the stated where the door 19 is opened as illustrated in FIG. 6B, since a restoring force is applied to the protruding portion 19*a*, which returns under restoring force to the state where it is not elastically deformed, the door 19 returns from the second shape to the first shape. If the door 19 is going to be closed without removing the ship lock 21, the protruding portion 19*a* abuts on the ship lock 21, which prevents the door 19 from closing. This is because, when the door 19 is restored from the second shape to the first shape, the protruding portion 19*a* moves so that the ship lock 21 is positioned on the locus where the door 19*a* moves when the door 19 is closed. Thus, the door 19 may be elastically deformed from the first shape to the second shape.

In the present exemplary embodiment, the ship lock for fixing the rotary developing device 8 provided with a retracting mechanism has been described. However, the present invention is not limited to a fixing mechanism using the ship lock of the rotary developing unit provided with such a retracting mechanism. More specifically, even when the rotary developing unit is not provided with the retracting mechanism, the image forming apparatus typically holds the appropriate clearance for a smooth operation during running time.

The present invention can be also applied to the fixing mechanism to fix the rotary developing unit including no such a retracting mechanism. Further, an object to be fixed by the ship lock does not need to be the rotary developing unit, but it may be, for example, a movable unit that is rotatably and movably held relative to a transfer roller and a charge roller included in the image forming apparatus. Furthermore, the removable member may not be the fixing member such as the ship lock but a toner seal for preventing toner filled in the developing cartridge 9 from leaking or a photosensitive drum cover for covering the photosensitive drum 11*a*.

Figure 10:
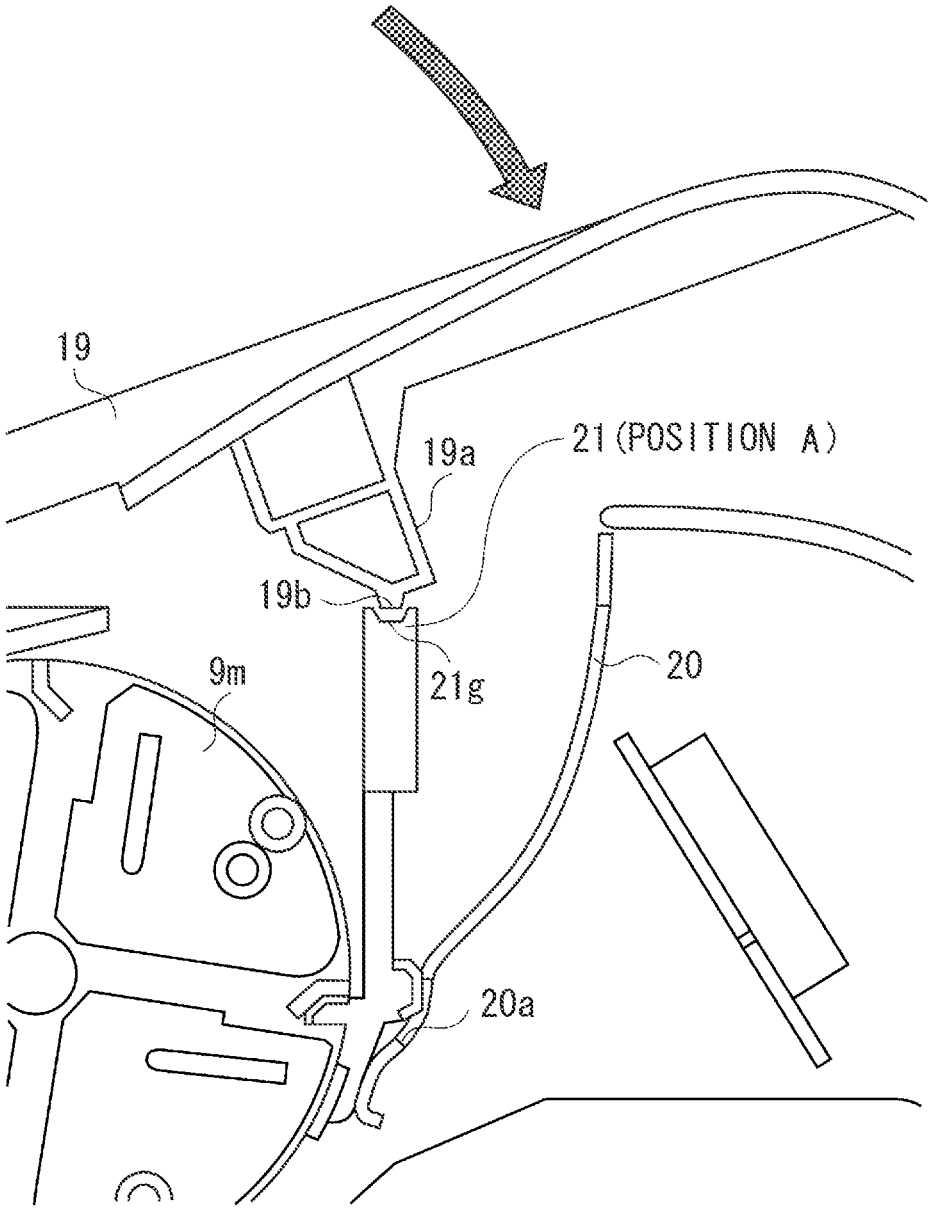
FIG. 10 is an enlarged view of a vertical cross sectional view of an image forming apparatus with a ship lock mounted and with a door closed.

Moreover, as illustrated in FIG. 10, engagement portions 19*b* and 21*g* that engage with the ship lock 21 and the door 19 may be provided respectively. With this arrangement, when the user is going to close the door 19 again without removing the ship lock 21, the ship lock 21 and the protruding portion 19*a* can more securely interfere with each other.

As described above, according to the present exemplary embodiment, regardless of whether other members are mounted before the apparatus is used, the user can easily recognize that he has forgotten to remove the ship lock from the apparatus.

By using the ship lock 21, having a part is elastically deformed with respect to another part described in the present exemplary embodiment, the following advantage can be acquired. With the ship lock mounted on the apparatus, an inner force of the ship lock itself urges the object to be fixed (i.e., rotary developing device 8) to lock it and prevent its movement. More specifically, in the state where the ship lock is mounted, the ship lock is fixed under stress from the apparatus and engaged with the apparatus so that a state in which the inner force of the ship lock itself is generated is maintained.

Therefore, to remove the ship lock from the apparatus, the ship lock needs to be forced to be released from the engagement with the apparatus. The greater the inner force generated by the ship lock itself is, the more firmly the ship lock needs to engage with the apparatus. Thus, the great force is necessary to release the ship lock from the engagement with the apparatus. According to the present exemplary embodiment, since, by opening the door 19, the ship lock 21 is restored from the second shape to the first shape, the force for urging the rotary developing device 8 is decreased, and thus, the inner force generated in the ship lock 21 is also decreased. Therefore, the force necessary to remove the ship lock is decreased, thereby increasing usability.

Figure 7:
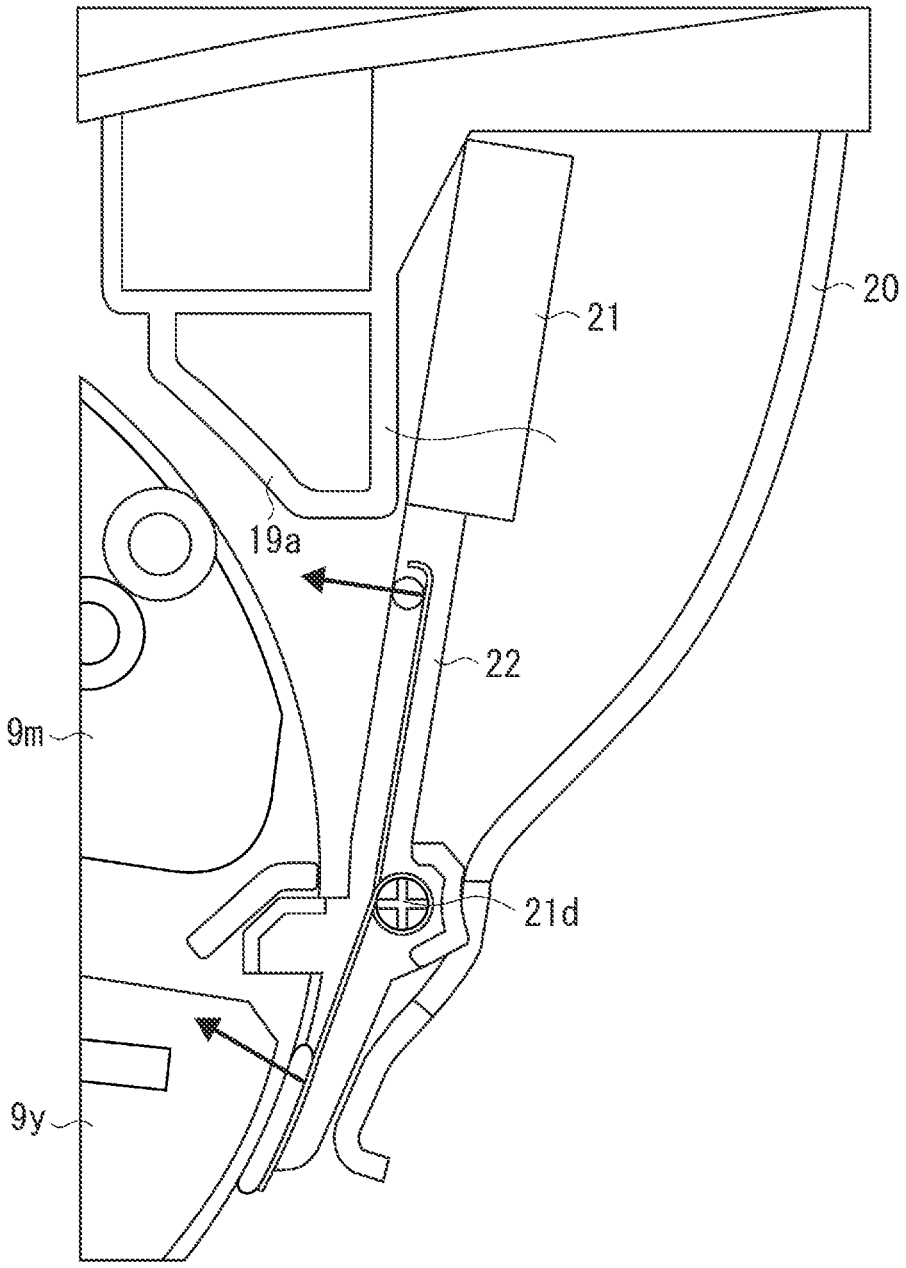
FIG. 7 is an enlarged view of a ship lock mounted portion of an image forming apparatus with a ship lock mounted.

Next a second exemplary embodiment of the present invention will be described. The same numeral figures are given to the same parts as in the first exemplary embodiment, and the descriptions will not be repeated. FIG. 7 is an enlarged view of a ship lock mounted portion of the image forming apparatus 1.

According to the first exemplary embodiment, using the elasticity, the ship lock 21 is elastically deformed from the first shape to the second shape. However, when the image forming apparatus 1 is exposed to a high-temperature environment during transportation, the ship lock 21 is creep-deformed, and thus, even when the door 19 is opened, the ship lock 21 may not be restored from the second shape to the first shape.

According to the present exemplary embodiment, as illustrated in FIG. 7, the ship lock 21 is provided with an urging member 22 (i.e. a spring) and, using the support point 21*d*, the ship lock 21 is urged in an arrow direction illustrated in FIG. 7. Therefore, the force for restoring the ship lock 21 to the first shape is applied thereto. According to the present exemplary embodiment, a twisted coil spring made of metal is used as the urging member 22 to avoid creep deformation even in a high temperature. With this arrangement, the restoring force for restoring the ship lock 21 from the second shape to the first shape can be supplemented by the urging member 22.

Figure 8:
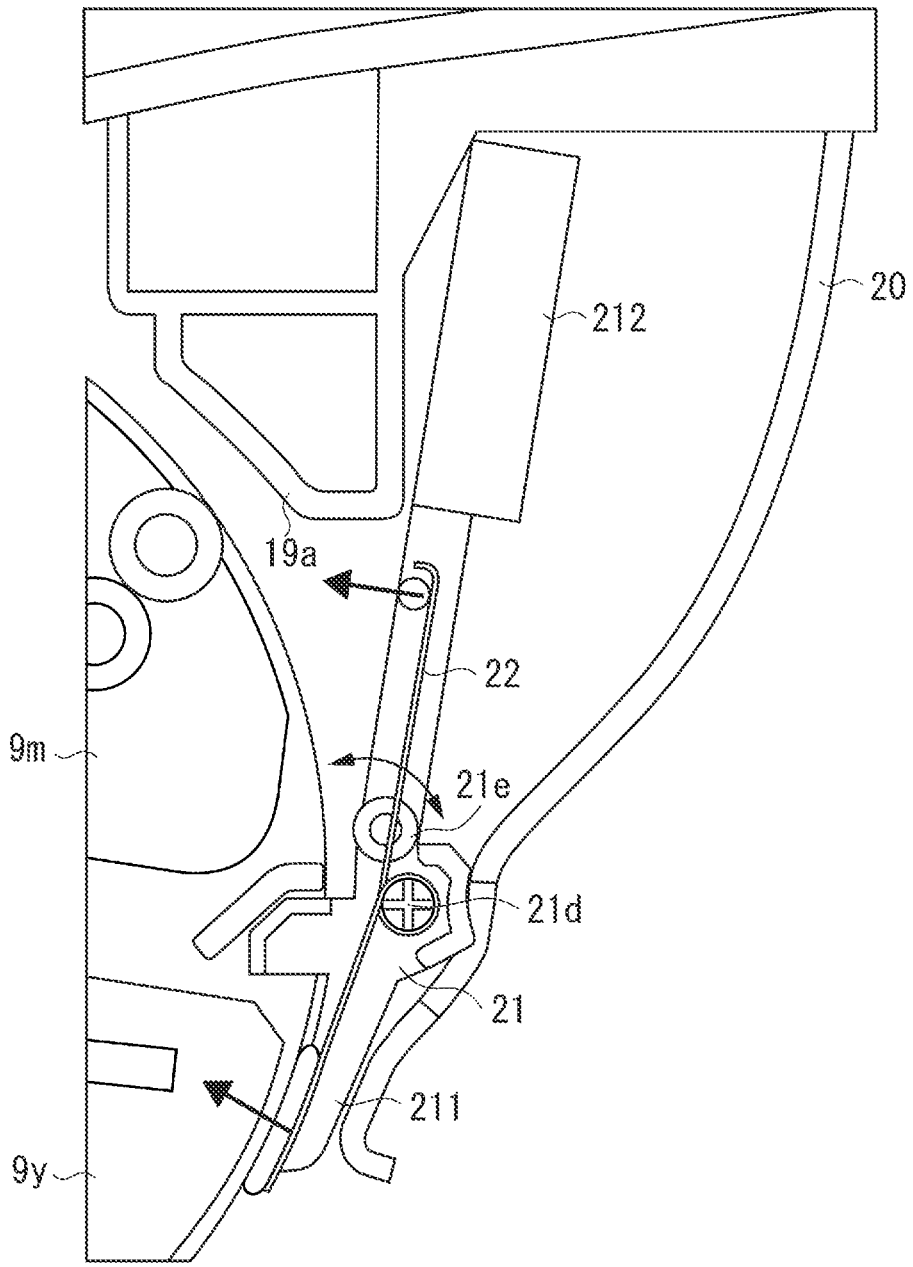
FIG. 8 is an enlarged view of a ship lock mounted portion of an image forming apparatus with a ship lock mounted.

Further, to restore the ship lock 21 from the second shape to the first shape more securely when the door 19 is opened, as illustrated in FIG. 8, the ship lock 21 may be divided into a lower ship lock main body member 211 and an upper flapper member 212. The ship lock main body member 211 and the upper flapper member 212 are rotatably connected to each other via a rotation shaft 21*d*. Further, the urging member 22 urges the lock main body member 211 and the upper flapper member 212 in each of arrow directions as illustrated in FIG. 8.

With this arrangement, the ship lock 21 can be restored to the first shape or the second shape, and the restoring force from the second shape to the first shape can also be acquired. Therefore, since the ship lock 21 itself is not elastically deformed, the ship lock 21 can be restored from the second shape to the first shape more securely when the door 19 is opened.

As described above, according to the present exemplary embodiment, an effect same as that of the first exemplary embodiment can be acquired. Further, the problem can be solved that the ship lock 21 is creep-deformed by the urging member 22.

Figure 9:
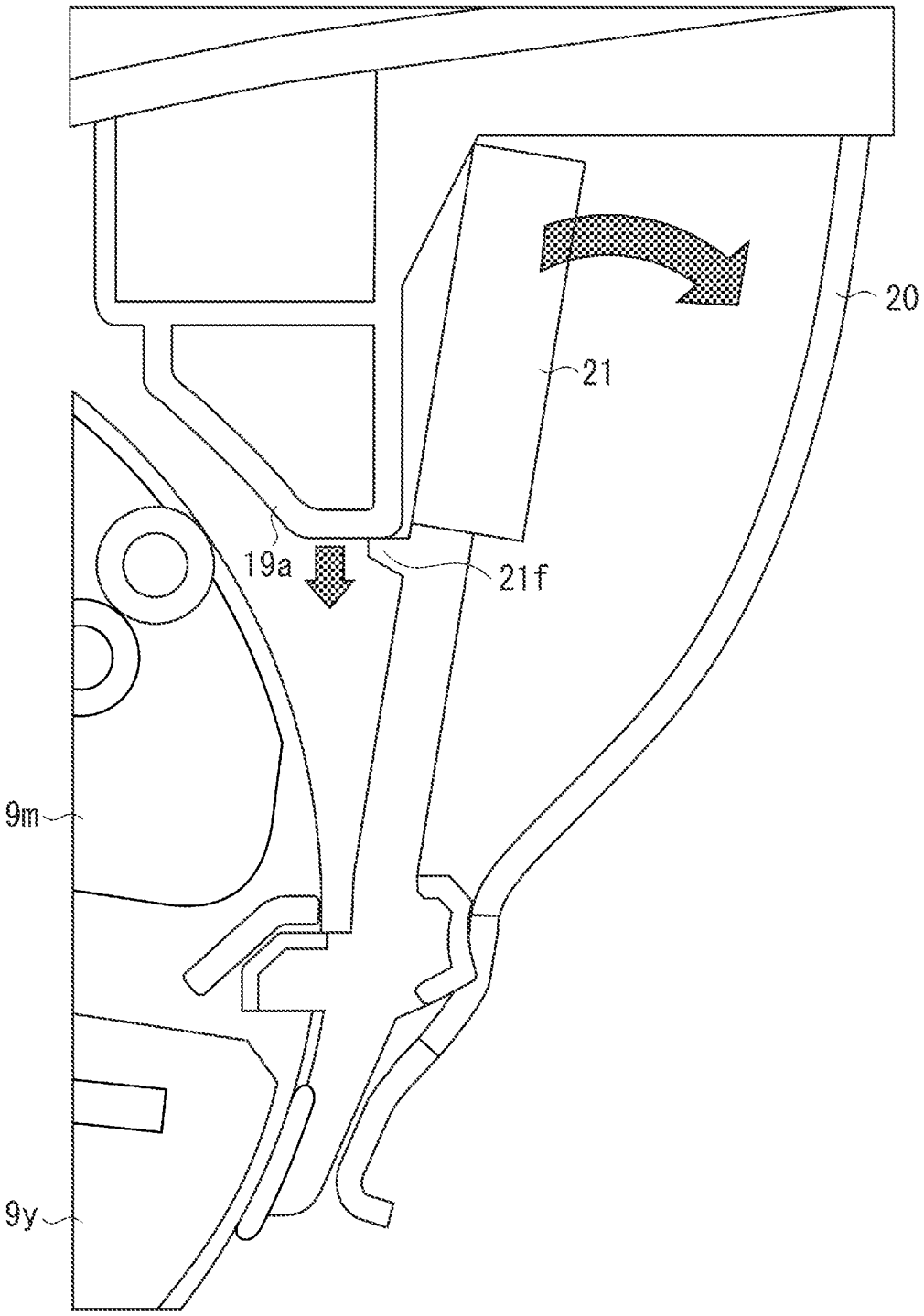
FIG. 9 is an enlarged view of a ship lock mounted portion of an image forming apparatus with a ship lock mounted.

Next, a third exemplary embodiment will be described. The same numeral figures are given to the same parts as in the first exemplary embodiment, and the descriptions will not be repeated. FIG. 9 is an enlarged view of a ship lock mounted portion of the image forming apparatus 1. The ship lock 21 of the present exemplary embodiment is provided with a raised portion 21*f*. In a state where the door 19 is closed when the elastically deformed portion of the ship lock 21 is positioned at the position "B" (second shape), this raised portion 21*f* is in contact with the protruding portion 19*a* of the door 19. On the other hand, the image forming apparatus 1 is provided with a door pressing unit (not illustrated) for pressing the door 19 with a certain pressing force when the door 19 is closed so that the door 19 is not easily opened.

Thus, the pressing force is applied to the raised portion 21*f* from above by the door pressing unit via the door 19, thereby inserting the ship lock 21 more deeply. With this arrangement, the pressing force applied by the rotary developing unit pressing unit 21*c* to the rotary developing device 8 is further increased to strengthen resistance against the shock and the vibration during transportation.

As described above, according to the present exemplary embodiment, the same effect as that of the first exemplary embodiment can be acquired. Further, the ship lock 21 can more firmly fix the rotary developing device 8 that is the object to be fixed when the door 19 is closed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-181891 filed Aug. 16, 2010, and No. 2011-166757 filed Jul. 29, 2011 which are hereby incorporated by reference herein in their entirety.

What is claimed is:

1. An image forming apparatus comprising:

an openable and closable member capable of opening and/or closing relative to the image forming apparatus; and a regulating member configured to regulate a movement of a member for forming an image, the regulating member being removable from a main body of the apparatus when the openable and closable member is in an open position, wherein, when the openable and closable member goes from the open position to a closed position, the regulating member is mounted to the main body of the apparatus in a second state that is changed from a first state;

when the openable and closable member goes from the closed position to the open position, the regulating member is restored to the first state;

in the second state, when the openable and closable member goes from the open position to the closed position, an abutting portion of the openable and closable member abuts on an abutting portion of the regulating member to regulate the openable and closable member from closing; and a direction of pressing caused when the abutting portion of the openable and closable member abuts on the abutting portion of the regulating member is different from a direction in which the abutting portion of the regulating member moves when the regulating member changes from the first state to the second state.

2. The image forming apparatus according to claim 1, wherein an engagement portion that engages with the abutting portion of the opening/closing portion is formed on the abutting portion of the regulating member.

3. The image forming apparatus according to claim 1, further comprising an urging member, which urges the regulating member to return from the second state to the first state.

4. The image forming apparatus according to claim 3, wherein the regulating member mounted in the main body of the apparatus includes a main body portion that abuts on a member for forming the image and a flapper portion that is movable relative to the main body portion; and wherein, when the flapper portion is moved relative to the main body portion, the regulating member can be changed to the first state or the second state, and the main body unit and the flapper unit are urged by the urging member to return from the second state to the first state.

5. The image forming apparatus according to claim 1, wherein, by rotating about a shaft, the openable and closable member is capable of opening and/or closing relative to the main body of the apparatus; and wherein, when the regulating member is mounted on the main body of the apparatus with the openable and closable member in the closed position, the regulating member is regulated from returning from the second state to the first state and substantially urges the openable and closable member toward the shaft.

6. The image forming apparatus according to claim 1, wherein a direction of pressing caused when the abutting portion of the openable and closable member abuts on the abutting portion of the regulating member is substantially orthogonal to a direction in which the abutting portion of the regulating member is moved when the regulating member is changed from the first state to the second state.

7. The image forming apparatus according to claim 1, further comprising a photosensitive member, wherein the member is a developing device supporting a plurality of developing units that develop a latent image on the photosensitive member.

8. The image forming apparatus according to claim 7, wherein the developing device is a developing rotary that rotatably holds the plurality of developing units.

9. The image forming apparatus according to claim 8, wherein, when a rotation shaft of the developing rotary moves away from the photosensitive member, the developing rotary can move from a development position where the latent image is developed on the photosensitive member to a retracting position where the developing rotary is retracted from the photosensitive member; and wherein the regulating member regulates the developing rotary from moving from the retracting position to the development position.

10. The image forming apparatus according to claim 1, wherein a force of the regulating member for urging a member for forming the image is smaller in the first state than in the second state.

11. An image forming apparatus comprising:

a developing device configured to hold a plurality of developing units that develop a latent image on a photosensitive member;

an openable and closable member capable of opening and/or closing relative to a main body of the apparatus; and a regulating member configured to regulate a movement of the developing device, the regulating member being removable from the main body of the apparatus in which the openable and closable member goes from a closed position to an open position, wherein, when the openable and closable member is closed, the regulating member is mounted on the main body of the apparatus in a second state that is changed from a first state;

when the openable and closable member goes from the closed position to the open position, the regulating member is returned to the first state; and in this state, when the openable and closable member goes from the open position to the closed position, an abutting portion of the openable and closable member abuts on an abutting portion of the regulating member to regulate the openable and closable member from closing.

12. The image forming apparatus according to claim 11, wherein the developing device is a developing rotary that rotatably holds the plurality of developing units.

13. The image forming apparatus according to claim 12, wherein, when a rotation shaft of the developing rotary moves away from the photosensitive member, the developing rotary can move from a development position where the latent image is developed on the photosensitive member to a retracting position where the developing rotary is retracted from the photosensitive member, and wherein the regulating member regulates the developing rotary from moving from the retracting position to the development position.

14. The image forming apparatus according to claim 12, wherein a force of the regulating member for urging a member for forming the image is smaller in the first state than in the second state.

15. An image forming apparatus comprising:

an openable and closable member capable of opening and/or closing relative to the image forming apparatus; and a regulating member configured to regulate a movement of a member for forming an image, the regulating member being removable from a main body of the apparatus in which an openable and closable member goes from a closed position to an open position, wherein the openable and closable member includes a change portion capable of changing to a second state to which a first state is elastically changed or a part of the first state is elastically changed relative to another portion;

wherein, when the openable and closable member is closed, the change portion is in the second state to which the first state is changed;

wherein, when the openable and closable member goes from the closed position to the open position, the change portion returns to the first state; and in this state, when the openable and closable member goes from the open position to the closed position, an abutting portion of the change portion abuts on an abutting portion of the regulating member to regulate the openable and closable member from closing.

16. The image forming apparatus according to claim 15, further comprising a photosensitive member, wherein the member is a developing device supporting a plurality of developing units that develop a latent image on the photosensitive member.

17. The image forming apparatus according to claim 16, wherein, when a rotation shaft of the developing rotary moves away from the photosensitive member, the developing rotary can move from a development position where the latent image is developed on the photosensitive member to a retracting position where the developing rotary is retracted from the photosensitive member; and wherein the regulating member regulates the developing rotary from moving from the retracting position to the development position.

* * * * *